US006735888B2

(12) United States Patent
Green et al.

(10) Patent No.: US 6,735,888 B2
(45) Date of Patent: May 18, 2004

(54) VIRTUAL CAMERA ON THE BUCKET OF AN EXCAVATOR DISPLAYING 3D IMAGES OF BURIED PIPES

(75) Inventors: Robert G. Green, Macon, GA (US); Thorkild Hansen, Brighton, MA (US); Michael Oristaglio, Newton, CT (US); Ralf Birken, Boston, MA (US); Ross Deming, Winchester, MA (US)

(73) Assignee: Witten Technologies Inc., Boston, MA (US)

( * ) Notice: Subject to any disclaimer, the term of this patent is extended or adjusted under 35 U.S.C. 154(b) by 0 days.

(21) Appl. No.: 10/143,423

(22) Filed: May 10, 2002

(65) Prior Publication Data

US 2003/0000115 A1 Jan. 2, 2003

Related U.S. Application Data

(60) Provisional application No. 60/292,130, filed on May 18, 2001.

(51) Int. Cl.[7] ..... E02F 5/02

(52) U.S. Cl. ..... 37/348

(58) Field of Search ..... 37/348, 382, 414; 172/2, 5, 6; 701/50; 414/699, 696

(56) References Cited

U.S. PATENT DOCUMENTS

| | | | | | |
|---|---|---|---|---|---|
| 4,600,356 | A | * | 7/1986 | Bridges et al. | 414/694 |
| 4,685,070 | A | * | 8/1987 | Flinchbaugh | 345/424 |
| 5,193,628 | A | | 3/1993 | Hill, III et al. | |
| 5,438,771 | A | * | 8/1995 | Sahm et al. | 37/348 |
| 5,467,290 | A | * | 11/1995 | Darland et al. | 342/463 |
| 5,479,729 | A | * | 1/1996 | Eslambolchi | 37/195 |
| 5,592,092 | A | * | 1/1997 | Mechler | 324/326 |
| 5,673,050 | A | * | 9/1997 | Moussally et al. | 342/22 |
| 5,904,210 | A | | 5/1999 | Stump et al. | |
| 6,039,141 | A | * | 3/2000 | Denny | 180/329 |
| 6,119,376 | A | | 9/2000 | Stump | |
| 6,161,630 | A | | 12/2000 | Stump et al. | |
| 6,195,922 | B1 | | 3/2001 | Stump | |
| 6,282,477 | B1 | * | 8/2001 | Gudat et al. | 701/50 |
| 6,377,872 | B1 | * | 4/2002 | Struckman | 700/258 |
| 6,434,508 | B1 | * | 8/2002 | Lin et al. | 702/153 |
| 6,437,726 | B1 | * | 8/2002 | Price | 342/22 |
| 6,532,409 | B1 | * | 3/2003 | Fujishima et al. | 701/50 |

FOREIGN PATENT DOCUMENTS

EP 0811726 A1 * 12/1997

* cited by examiner

*Primary Examiner*—Victor Batson
(74) *Attorney, Agent, or Firm*—Fulbright & Jaworski L.L.P.

(57) ABSTRACT

We describe a system for displaying buried utilities to the operator of an excavator. The display is based on 3D images of the subsurface obtained from advanced locating methods. As the excavator moves, the display changes so that it remains centered on the region near the bucket where the buried pipes are in danger of being broken.

13 Claims, 3 Drawing Sheets

VIRTUAL CAMERA ON THE BUCKET OF AN EXCAVATOR DISPLAYING 3D IMAGES OF BURIED PIPES

RELATED APPLICATIONS

The present application claims priority to U.S. Provisional Application No. 60/292,130 that was filed on May 18, 2001.

FIELD OF THE INVENTION

This invention generally pertains to a system for providing images of subsurface objects. In particular, the invention provides a system for displaying three-dimensional images of buried pipes and other objects to the operator of an excavator or other such equipment.

BACKGROUND

A precise map of the subsurface is essential to avoid damaging existing utilities (water, gas, electric lines, etc.) during excavation. For example, prior to digging trenches to install new pipes, a construction crew must know where the existing pipes are buried to avoid damaging them. A lack of accurate maps of construction sites results each year in thousands of damaged utilities and losses of billions of dollars.

Advanced locating technology such as ground penetrating radar and inductive systems can provide accurate three-dimensional ("3D") maps of buried utilities. However, these maps are not very useful during excavation unless the information they contain is readily accessible to the operator of the excavator. The present invention comprises a system that displays a movie taken with a virtual video camera positioned on the bucket of an excavator. The movie is based on 3D images obtained from advanced locating technology and no physical camera is needed. The virtual camera is created by integrating four position sensors on the excavator with a single ground position sensor. This enables the virtual camera to deliver 3D images of the bucket teeth in relation to the ground and the utilities buried underneath. Existing software can be used without modification to generate the display. For example, MATLAB has the capability of displaying 3D images with user-defined camera position and camera target. MICROSTATION and AUTOCAD also have the ability to produce real-time 3D displays.

Most often the available information about buried utilities is painted onto the street and is thus visible only until the top layer is removed. Obviously this approach makes it difficult for the operator of an excavator to avoid damaging pipes during excavation.

Spectra Precision (www.spectraprecision.com) builds numerous systems that can be adapted to track construction equipment. One such system is called the BUCKET-PRO and displays to the operator of an excavator the 3D location of the bucket in relation to previously imaged utilities. For example, if a trench needs to have a certain fixed depth, the operator can set that depth on his display and continuously monitor the position of the bucket relative to that depth. BUCKET-PRO uses self-tracking laser theodolites and a dual-axis slope sensor.

SUMMARY OF THE INVENTION

A sub-surface video system for an excavator is disclosed comprising an excavator with a body, a stick, a main boom, and a bucket, a three-dimensional sub-surface image of an excavation area where the image is positioned with respect to a first fixed coordinate system, a positioning device for determining the position of the bucket with respect to a second fixed coordinate system having a known relation with respect to the first fixed coordinate system, and, a video monitor for displaying the image at a desired depth below the position of the bucket.

In one embodiment of the invention, the positioning device comprises a first positioning device for determining the position of the bucket with respect to the body, and a second positioning device for determining the position of the body with respect to the second fixed coordinate system.

In a further embodiment, the first positioning device comprises a first position sensor to determine the angle between the body and the main boom, and a second position sensor to determine the angle between the main boom and the stick. In another embodiment, the system further comprises a third position sensor to determine the angle between the bucket and the stick.

In yet another embodiment, the second positioning device comprises three reflectors attached to the body, a GEODIMETER device positioned at a fixed point and capable of tracking the three reflectors, thereby determining the position and orientation of the body, a transmitter on the GEODIMETER device for transmitting the position and orientation, and a receiver on the excavator for receiving the position and orientation from the transmitter.

In a further embodiment, the second positioning device comprises a reflector attached to the body, a GEODIMETER device positioned at a fixed point and capable of tracking the reflector, thereby determining the position of the body, a transmitter on the GEODIMETER device for transmitting the position, a receiver on the excavator for receiving the position from the transmitter, and a gyroscope and dual-axis slope sensor on the body for determining the orientation of the body.

In one embodiment, the first coordinate system is a street coordinate system. In a second embodiment, the second coordinate system is a street coordinate system. In a third embodiment, the first coordinate system is a global coordinate system. In a fourth embodiment, the second coordinate system is a global coordinate system.

In an additional embodiment, the image is a volumetric image. In another embodiment, the image is a depth color-coded image.

In one embodiment, the excavator further comprises a ring gear and the positioning device comprises a position sensor in the ring gear to determine the rotational position of the ring gear. In another embodiment, the first fixed coordinate system is the same as the second fixed coordinate system.

DETAILED DESCRIPTION

The present invention is comprised of two main components, which are largely independent. The first component is a 3D image of the subsurface of the area under excavation. The second component consists of positioning devices for the excavator. Both the 3D image and the excavator position can be given in terms of street coordinates (related to any fixed feature in the survey area) or global coordinates (such as latitude-longitude-height or Universal Transverse Mercator coordinates). The term "fixed coordinate system" will be used to denote either of these coordinate systems.

Image of the Subsurface

The 3D image is obtained from a previous survey of the area to be excavated. The survey tool is typically moved over the survey area on a trailer or directly attached to a vehicle. This tool may perform a number of measurements including, for example, (a) radar measurements, (b) induction measurements, (c) measurements of magnetic fields emitted by pipes on which currents have been injected, (d) measurements of the magnetic fields emitted by power lines, (e) measurement of the static magnetic field, and (f) photographic pictures recorded with videos, web cams, or other types cameras. The resulting 3D image must be positioned with respect to a fixed coordinate system. One method for accomplishing this positioning is described in copending U.S. patent application Ser. No. 10/097,713 ("Method For Merging Position Information With Measurements And Filtering To Obtain High-Quality Images That Are Positioned Accurately With Respect To Global Coordinates"), which is hereby incorporated by reference into the present application.

Figure 1:
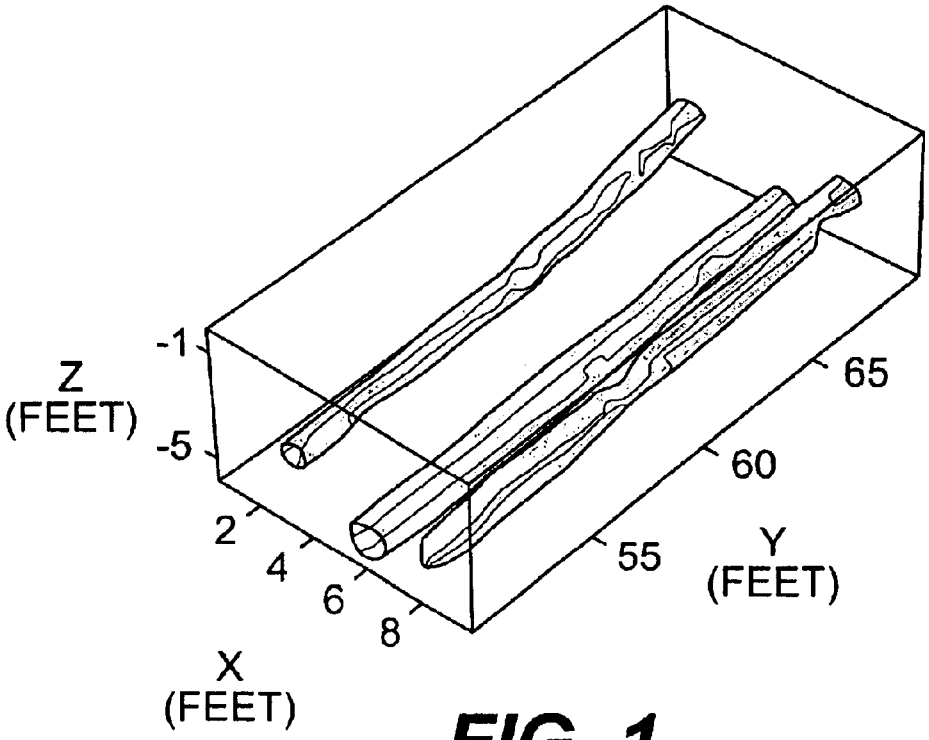
FIG. 1 is an example of a volumetric three-dimensional image suitable for use with the present invention.
Figure 2:
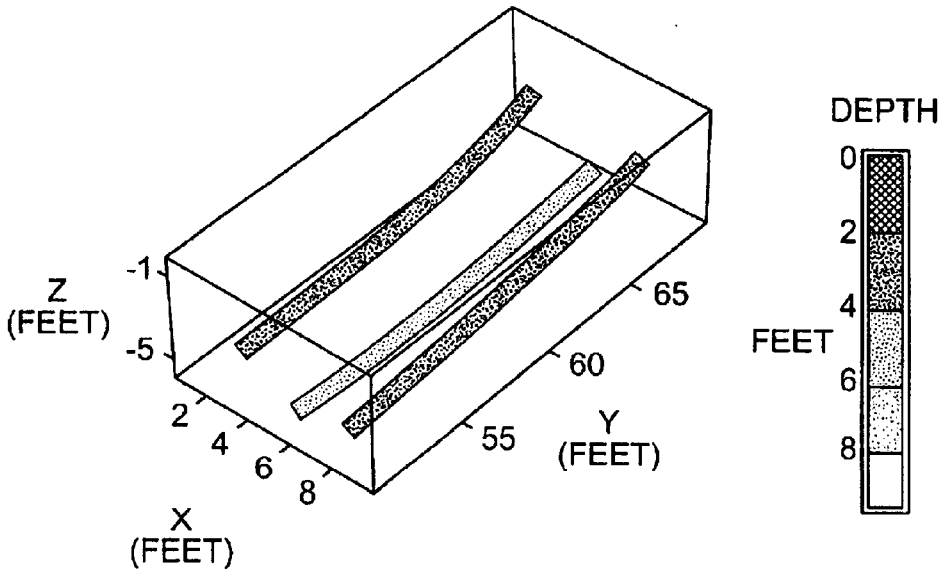
FIG. 2 is an example of a depth color-coded three-dimensional image suitable for use with the present invention.

The 3D image can be volumetric as in FIG. 1, or depth color-coded lines as in FIG. 2. Standard visualization software such as MATLAB, MICROSTATION, AUTOCAD, and other similar applications known to those of skill in the art can then view the image from a user-specified perspective. For example, with MATLAB Version 6 available from MathWorks, the image is stored in a "fig" file that can be loaded onto a computer in the excavator from a CD. The desired perspective can then be obtained from MATLAB by simply setting the variable "campos" to be the position of the bucket and the variable "camtarget" to a pre-selected depth controlled by the operator below the bucket. The display would then continuously show the utilities or objects in danger of being broken by the excavator.

Positioning Devices for the Excavator

Figure 3:
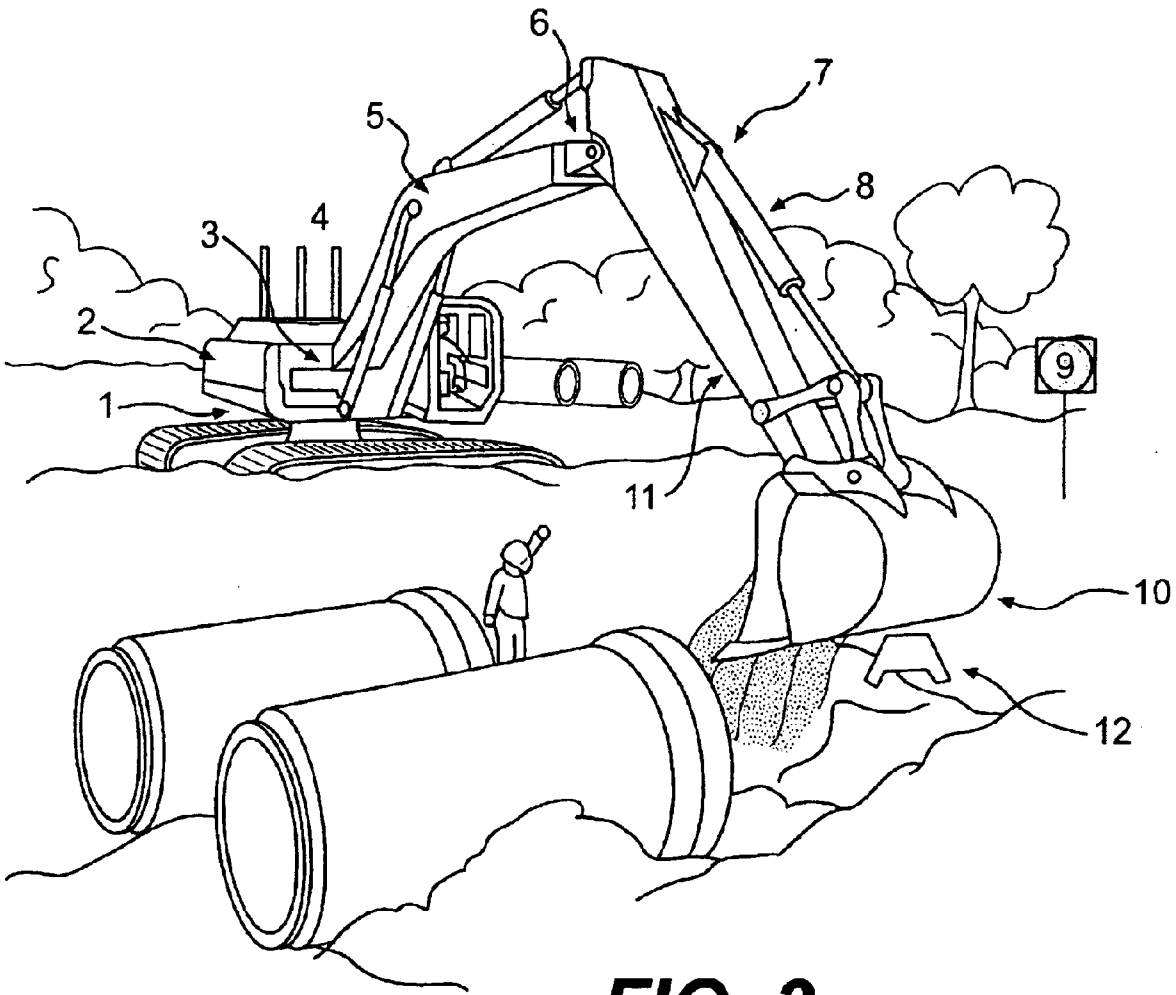
FIG. 3 shows an excavator equipped with an embodiment of the present invention.

The positioning devices for the excavator consist of two to four sensors that collectively determine the position of the bucket in a fixed coordinate system that can be related to the fixed coordinate system of the 3D image. (The coordinate systems of the excavator and the 3D image need not be identical, as long as the relation between them is known.) Because of the strong forces exerted on the bucket and maintenance issues, it is desirable to keep the area near the bucket free from sensors. Hence, we separately determine (1) the position of the bucket with respect to the excavator body and (2) the coordinates and orientation of the excavator body. Then, we combine these measurements to obtain the position of the bucket in the fixed coordinate system. FIG. 3 shows an excavator that may be used with the present invention.

Referring to FIG. 3, to determine the position of bucket 10 (and virtual camera 12) with respect to excavator body 2, position sensor 1 is in the ring gear of excavator body 2 to determine rotational position. A second sensor 3 measures the angle between excavator body 2 and main boom 5. A third position sensor 6 measures the angle between main boom 5 and stick 11. An optional fourth position sensor 7 determines the position of hydraulic cylinder 8 for bucket 10 and thereby determines the angle of bucket 10. (It is preferable to avoid having sensors near bucket 10.) Position sensor 7 is not needed if the position of the end of stick 11 gives sufficient information to position the 3D image. However, for some applications it may be necessary to take into account the angle of bucket 10 to make the position of the 3D image accurate enough with respect to bucket 10.

Although position sensor 1 is not required in the embodiment of FIG. 3 to determine the position of the bucket, it may be used to eliminate the need for GEODIMETER device 9 in applications where the excavator tracks remain fixed in a known position. In such cases, position sensor 1 may be used to determine the position of the body with respect to the known fixed position of the excavator tracks, thereby permitting the position of the bucket to be determined.

To determine the location and orientation of the excavator body with respect to a fixed coordinate system (ground position), three reflectors 4 are attached to excavator body 2. GEODIMETER device 9 is stationed at a fixed point on the ground and continuously tracks the three reflectors 4. GEODIMETER device 9 continuously sends via radio waves the position of the reflectors to a receiver on the excavator. With the position of the three reflectors 4 one can compute the position and orientation of excavator body 2, and thus compute the position of bucket 10 in the fixed coordinate system.

Numerous other methods can be used to determine the location and orientation of excavator body 2. For example, instead of the three reflectors 4 mounted on the excavator, one could use only one reflector in conjunction with a gyroscope and a dual-axis slope sensor. Any of these embodiments can easily be implemented by those skilled in the art. The following companies build tracking tools that may be used with the present invention: Leica Geosystems, Trimble Navigation Ltd., Spectra Precision, NovAtel Inc., Sokkia Co. Ltd., Applanix Corp., Measurement Devices Ltd., and Nedo.

Conclusion

The present invention, therefore, is well adapted to carry out the objects and obtain the ends and advantages mentioned above, as well as others inherent herein. All presently preferred embodiments of the invention have been given for the purposes of disclosure. Where in the foregoing description reference has been made to elements having known equivalents, then such equivalents are included as if they were individually set forth. Although the invention has been described by way of example and with reference to particular embodiments, it is not intended that this invention be limited to those particular examples and embodiments. It is to be understood that numerous modifications and/or improvements in detail of construction may be made that will readily suggest themselves to those skilled in the art and that are encompassed within the spirit of the invention and the appended claims.

I claim:

1. A sub-surface video system for an excavator, comprising:

an excavator comprising a body, a stick, a main boom, and a bucket;

a three-dimensional sub-surface depth color-coded image of an excavation area wherein said image is positioned with respect to a first fixed coordinate system;

a positioning device for determining the position of said bucket with respect to a second fixed coordinate system having a known relation with respect to said first fixed coordinate system; and, a video monitor for displaying said image at a desired depth below said position of said bucket.

2. The system of claim 1, wherein said positioning device comprises:

a first positioning device for determining the position of said bucket with respect to said body; and, a second positioning device for determining the position of said body with respect to said second fixed coordinate system.

3. The system of claim 2, wherein said first positioning device comprises:

a first position sensor to determine the angle between said body and said main boom; and, a second position sensor to determine the angle between said main boom and said stick.

4. The system of claim 3, further comprising a third position sensor to determine the angle between said bucket and said stick.

5. The system of claim 2, wherein said second positioning device comprises:

three reflectors attached to said body;

a GEODIMETER device positioned at a fixed point and capable of tracking said three reflectors, thereby determining the position and orientation of said body;

a transmitter on said GEODIMETER device for transmitting said position and orientation; and, a receiver on said excavator for receiving said position and orientation from said transmitter.

6. The system of claim 2, wherein said second positioning device comprises:

a reflector attached to said body;

a GEODIMETER device positioned at a fixed point and capable of tracking said reflector, thereby determining the position of said body;

a transmitter on said GEODIMETER device for transmitting said position;

a receiver on said excavator for receiving said position from said transmitter; and, a gyroscope and dual-axis slope sensor on said body for determining the orientation of said body.

7. The system of claim 1 wherein said first coordinate system is a street coordinate system.

8. The system of claim 1 wherein said second coordinate system is a street coordinate system.

9. The system of claim 1 wherein said first coordinate system is a global coordinate system.

10. The system of claim 1 wherein said second coordinate system is a global coordinate system.

11. The system of claim 1 wherein said image is a volumetric image.

12. The system of claim 1 wherein said excavator further comprises a ring gear and wherein said positioning device comprises a position sensor in said ring gear to determine the rotational position of said ring gear.

13. The system of claim 1 wherein said first fixed coordinate system is the same as said second fixed coordinate system.

* * * * *